US006513681B2

(12) United States Patent
Gross et al.

(10) Patent No.: US 6,513,681 B2
(45) Date of Patent: Feb. 4, 2003

(54) SPRAY CLOSURE WITH A PUSH-PULL SEAL

(75) Inventors: Richard A. Gross, Oconomowoc, WI (US); Dieter F. Lay, Oconomowoc, WI (US); Marge M. Hicks, Eagle, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/791,075

(22) Filed: Feb. 22, 2001

(65) Prior Publication Data

US 2002/0113090 A1 Aug. 22, 2002

(51) Int. Cl.[7] ..... B65D 37/00
(52) U.S. Cl. ..... 222/211; 222/212; 222/525
(58) Field of Search ..... 222/211, 212, 222/464, 519–523, 525, 190

(56) References Cited

U.S. PATENT DOCUMENTS

| | | | | |
|---|---|---|---|---|
| 3,572,590 A | | 3/1971 | Malone | |
| 3,622,049 A | | 11/1971 | Thompson | |
| 4,223,842 A | | 9/1980 | Hayes | |
| 5,004,127 A | * | 4/1991 | Morel | 222/521 |
| 5,110,051 A | | 5/1992 | Bennett | |
| 5,301,846 A | | 4/1994 | Schmitz | |
| 5,467,898 A | * | 11/1995 | Hori | 222/211 |
| 5,501,377 A | * | 3/1996 | Dubach | 222/521 |
| 5,715,977 A | * | 2/1998 | Goncalves | 222/520 |
| 6,244,476 B1 | * | 6/2001 | Moretti | 222/521 |

FOREIGN PATENT DOCUMENTS

JP 9077109 3/1997

* cited by examiner

*Primary Examiner*—Joseph A. Kaufman
(74) *Attorney, Agent, or Firm*—Wood, Phillips, Katz, Clark & Mortimer

(57) ABSTRACT

A spray dispensing closure includes a spray plug and a cap cooperating therewith to selectively occlude passages in the spray plug. In one embodiment, a spray plug includes a set of inner passages for conveying product from a dip tube through the spray plug and a set of outer passages for conveying air from a head space in the container. The inner passages communicate with an inner flow space and the outer passages communicate with an outer flow space. A cap cooperates with the spray plug to define an outer chamber and an inner chamber which are isolated from one another when the cap is in the closed position, thereby preventing the mixing of air and product. As the cap is moved to the open position, the cap chambers are permitted to communicate with one another and, as the container is squeezed, a product/air mixture is formed in the closure. A central spray plug post has an upper portion that forms at least one restrictive passage with an inner wall of the cap when the cap is in the open position. As the air/product mixture flows through the restrictive passages, a spray mist is formed and dispensed through at least one dispensing orifice formed in the cap and communicating with the restrictive passages. In an alternative embodiment, only a single set of inner passages are provided on the spray plug and communicate with the head space in the container. A series of dip tube exit passages are formed by a proximal end of the dip tube and a plurality of dip tube end engaging ribs extending from the spray plug. When the container is squeezed and the cap is open, product is conveyed from the dip tube and into the inner passages to be mixed with air from the head space.

21 Claims, 11 Drawing Sheets

SPRAY CLOSURE WITH A PUSH-PULL SEAL

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The invention relates to resealable dispensing closures. More particularly, the invention relates to resealable dispensing closures for dispensing a spray of product and which accommodate closing and opening through axial movement of one element with respect to another, such as with a rotational, threaded or cam engagement or with a sliding, push-pull arrangement.

BACKGROUND OF THE INVENTION AND TECHNICAL PROBLEMS POSED BY THE PRIOR ART

Dispensing closures for dispensing a spray of product, such as cosmetics or medicaments, when a deformable container is squeezed, are generally known in the art. One known spray or mist dispensing closure comprises a spray plug, which includes a spray orifice for creating a mist and which is inserted into the neck of a container finish. A separate overcap or closure engages the spray plug and seals the spray plug orifice. Another known spray dispensing closure includes a spray plug with a flip-open, hinged cap for sealing the spray plug orifice.

Known dispensing closures for dispensing a spray of product are characterized by a number of disadvantages. For example, the overcap used to seal known dispensing spray closures may be lost, if it is separate from the spray plug, or may interfere with the dispensing, if it is hingedly secured to the spray plug. Moreover, the use of overcaps, whether separate or hinged, limits the aesthetic variety and therefore the appeal of such known closures.

It would therefore be advantageous to provide a resealable dispensing closure for dispensing a spray of product and which eliminates these shortcomings in the prior art. Specifically, it would be advantageous to provide a resealable dispensing closure for dispensing a mist or spray and which can be opened and resealed through axial movement of one or more elements of the closure, such as with a rotational, threaded or cam arrangement or with a sliding, pull-push arrangement.

It would also be advantageous if such an improved closure could accommodate bottles, containers, or packages which have a variety of shapes and that are constructed from a variety of materials. Further, it would be desirable if such an improved system could accommodate efficient, high-quality, large volume manufacturing techniques with a reduced product reject rate to produce a system with consistent operating characteristics.

BRIEF SUMMARY OF THE INVENTION

The present invention provides an improved dispensing closure system which addresses the aforementioned disadvantages in the prior art. Specifically, the present invention provides a resealable spray closure which may be closed and opened by axial movement of one closure component relative to another. Such closures may be opened and closed by respective pulling and pushing movement of one or more slidably engaged elements of the closure, or may be opened and closed by axial movement which may be accompanied by, or may result from, rotational movement of one or more components of the closure such as along a helical thread, track, or cam. The system is especially suitable for dispensing liquids that are best applied in a spray or mist form, such as perfumes, medicaments, or household products.

In one preferred embodiment, the invention provides a generally circular spray plug having a spray plug deck from which extends a spray plug seal for sealingly engaging an internal surface of a container neck. Extending from the spray plug deck in a direction generally opposite the spray plug seal is a central spray plug post. An annular spray plug inner wall is spaced from and surrounds the spray plug post to define an inner flow space. At least one inner passage is formed in the spray plug deck in an area between the post and inner wall such that the inner flow space communicates with product in a dip tube extending from the spray plug through a head space defined in the container and having a dip tube inlet communicating with product in the container. In this embodiment, the spray plug also includes an outer wall which is spaced from and surrounds the inner wall to define an outer flow space therebetween. At least one outer passage is formed in the spray plug deck in an area between the outer wall and the inner wall such that the outer flow space communicates with air in the container head space.

In this embodiment, a cap cooperates with the spray plug to define an outer chamber and an inner chamber. Specifically, a cap outer wall of the cap sealingly and slidingly engages the spray plug outer wall of the spray plug. A cap inner wall sealingly and slidingly engages both the spray plug inner wall and the spray plug post when the cap is in a closed position. Thus, when the cap is in the closed position, the outer chamber is defined by the spray plug deck on the bottom, the upper end wall of the cap on the top, the cap outer wall, the spray plug outer wall, the spray plug inner wall and the cap inner wall. Similarly, when the cap is in the closed position, an inner chamber is defined by the spray plug deck on the bottom, the spray plug post, the spray plug inner wall and the bottom end of the cap inner wall. As the cap is moved to the open position, the bottom end of the cap inner wall is withdrawn from the inner flow space, thus permitting communication between the outer chamber and the inner chamber. As the container is squeezed, both air and product flow from the outer chamber and inner chamber, respectively, and are mixed to form an air/product mixture. The spray plug post has an upper portion that forms at least one restrictive passage with the cap inner wall when the cap is in the open position. As the air/product mixture flows through the restrictive passages, a spray is formed and dispensed through at least one dispensing orifice formed in the upper end of the cap and communicating with the restrictive passages.

In another preferred embodiment, useful with container neck finishes which have a limited internal dimension that may not permit the outer passages of the above-described embodiment, the invention provides a closure having a spray plug with only a set of inner passages and no outer passages, yet mixing of product and air are accomplished. Specifically, this embodiment of the invention provides a generally circular spray plug having a spray plug deck from which extends a spray plug seal for sealingly engaging an internal surface of a container neck. An annular spray plug inner wall extends upward from the spray plug deck. A plurality of radially inwardly extending spray plug post support arms support a central spray plug post surrounded by the annular spray plug inner wall. The spray plug post support arms also extend downward to form a plurality of dip tube surface engaging members which engage the cylindrical surface of a dip tube and secure it to the spray plug. The spray plug post support arms and dip tube surface engaging members form a plurality of inner passages for permitting the flow of air contained in a container head space from the container through the spray plug. The spray plug also includes a plurality of dip tube end engaging ribs which form a like plurality of dip tube exit passages with an end of the dip tube that is proximal the spray plug and which thus permit flow of product from inside the dip tube and radially outward, between the dip tube surface engaging members and into the inner passages.

In this embodiment, a cap cooperates with the spray plug to selectively occlude the inner passages and prevent flow of the air and product mixture from the container. Specifically, a cap inner wall extends from a cap upper end wall and sealingly and slidingly engages both an inner surface of the spray plug inner wall and the spray plug post when the cap is in a closed position. A bottom portion of the spray plug post is provided with a smooth outer cylindrical surface which forms a seal with a seal bead on the cap inner wall when the cap is in a closed position. The spray plug post has an upper portion that forms at least one restrictive passage with the cap inner wall when the cap is in the open position. As the cap is moved to the open position, the cap inner wall is withdrawn from the inner flow space, thus permitting the air/product mixture to flow through the inner passages as the container is squeezed. As the air/product mixture flows through the restrictive passages, a spray is formed and dispensed through at least one dispensing orifice formed in the cap and communicating with the restrictive passages.

According to a primary aspect, the invention provides a spray closure for a container, including a container opening, for producing a spray, the spray closure comprising: (A) a spray plug for engaging the container adjacent opening, the plug including (1) a spray plug skirt for supporting the spray plug on the container, (2) a spray plug post supported relative to the spray plug skirt, (3) a plug wall substantially surrounding the spray plug post to define an inner flow space therewith, and (4) least one passage formed in the spray plug for permitting flow from the container into the inner flow space; and (B) a cap cooperating with the spray plug and adapted to move with respect to the spray plug from a closed position to an open position, the cap including: (1) an end wall defining a dispensing orifice defined therein for permitting flow through the cap; and (2) an inner wall extending from the end wall and adapted to seal the inner flow space when the cap is in the closed position to thereby prevent flow from the inner flow space out of the spray plug.

According to another primary aspect, the invention provides a spray closure for a container for producing a spray, the spray closure comprising: (A) a spray plug for engaging the container, the spray plug including (1) a spray plug seal for sealingly engaging the container, (2) a spray plug post, (3) a spray plug inner wall spaced from, and surrounding, the spray plug post to define a product flow space therewith for communicating with product in the container, (4) a spray plug outer wall spaced from, and surrounding, the spray plug inner wall to define an air flow space therewith; and (B) a cap cooperating with the spray plug and adapted to move with respect to the spray plug from a closed position to an open position; the cap including (1) a cap inner wall that (a) defines a mixing chamber on an interior thereof and (b) is adapted to isolate the product flow space from the air flow space when the cap is in the closed position, the cap inner wall further adapted to permit fluid communication between the product flow space and the air flow space when the cap is moved to the open position, thereby permitting the mixing of air and product to form a mist in the mixing chamber, and (2) a cap orifice in fluid communication with the mixing chamber for permitting flow of mist from the mixing chamber.

Another primary aspect of the invention provides a spray closure for a container for producing a mist spray, the spray closure comprising: (A) a spray plug for engaging the container, the spray plug including (1) a spray plug deck, (2) a spray plug seal extending from the deck for sealingly engaging the container, (3) a spray plug post extending from the deck in a direction generally opposite the spray plug seal, (4) a spray plug inner wall extending from the deck and surrounding the spray plug post to define a product flow space therewith, (5) at least one product passage formed in the spray plug deck between the spray plug post and the spray plug inner wall for permitting flow of product from the container through the spray plug deck to the product flow space, (6) a spray plug outer wall extending from the spray plug deck surrounding the spray plug inner wall to define an air flow space therewith, and (7) at least one air passage formed in the spray plug deck between the spray plug outer wall and the spray plug inner wall for permitting flow of air from the container through the spray plug deck to the air flow space; and (B) a cap cooperating with the spray plug and adapted to move with respect to the spray plug from a closed position to an open position; the cap including (1) a cap inner wall defining a mixing chamber on an interior thereof and adapted to isolate the product flow space from the air flow space when the cap is in the closed position, the cap inner wall further adapted to permit fluid communication between the product flow space and the air flow space when the cap is moved to the open position, thereby permitting the mixing of air and product to form a mist in the mixing chamber, (2) a cap outer wall adapted to sealingly engage the spray plug outer wall at the open and closed position and at any intermediate position; and (3) a cap orifice in fluid communication with the mixing chamber for permitting flow of mist from the mixing chamber.

Yet another primary aspect of the invention provides a spray closure for a container for producing a mist spray, the spray closure comprising: (A) a spray plug for engaging the container, the spray plug including (1) at least one air passage formed therein for permitting flow of air from the container through the spray plug and (2) at least one product passage formed therein for permitting flow of product from the container through the spray plug; and (B) a cap cooperating with the spray plug and adapted to move with respect to the spray plug from a closed position to an open position, the cap including a dispensing orifice for permitting flow of mist spray through the cap; (C) the cap and spray plug cooperating to define (1) an air chamber in communication with the at least one air passage, (2) a product chamber in communication with the at least one product passage, and (3) an isolation seal for isolating the air chamber from the product chamber when the cap is in the closed position, the isolation seal permitting communication between the air chamber, the product chamber and the dispensing orifice when the cap is in the open position.

The invention offers the advantage of providing a resealable, spray dispensing closure for mixing a product with air. The closure may be opened and resealed with movement of one closure component relative to another and without the need for overcaps of the prior art. Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, and sold in an orientation other than the position described.

The dispensing system of this invention is suitable for use with a variety of conventional or special containers having various designs, the details of which, although not completely illustrated or described herein, would be apparent to those having skill in the art and an understanding of such containers. The various containers per se described herein have neck and shoulder finishes adapted to cooperate with the closure of the present invention, but such containers form no part of, and therefore are not intended to limit, the present invention. It will also be understood by those of ordinary skill that novel and non-obvious inventive aspects are embodied in the described exemplary closure alone.

Figure 1:
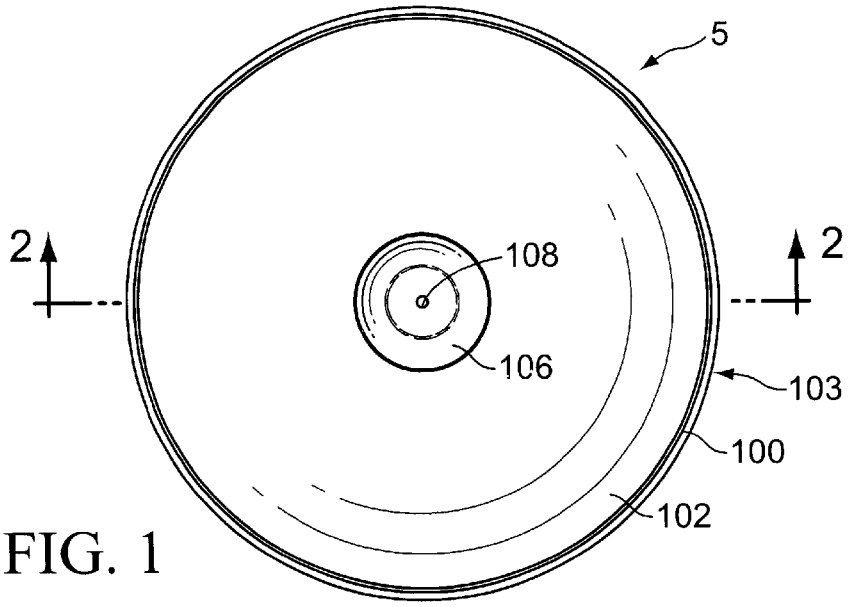
FIG. 1 is top plan view of an exemplary dispensing closure according to a preferred embodiment of the invention.
Figure 2:
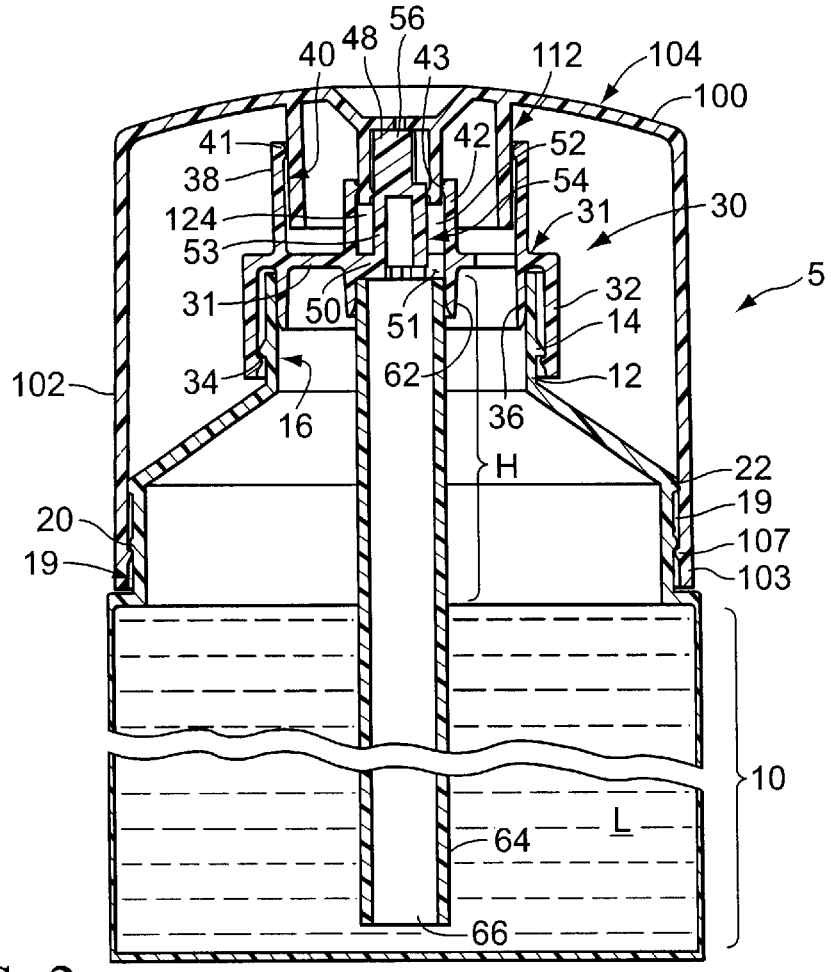
FIG. 2 is a cross-sectional view taken along lines 2—2 of FIG. 1, showing the exemplary dispensing closure in a closed position and installed on a container.

An exemplary closure according to a first preferred embodiment of the invention is generally referenced with the number 5 and illustrated in FIGS. 1–8 in association with a container 10. The container 10 with which the closure 5 may be used would typically be a squeezable container having a flexible wall or walls which can be grasped by the user and squeezed or compressed to increase the internal pressure within the container so as to force the product and the air out of the container and through the closure 5. The container wall typically has sufficient, inherent resiliency so that when the squeezing forces are removed, the container wall returns to its normal, unstressed shape. Such a squeezable wall container is preferred in many applications but may not be necessary or preferred in other applications. For example, in some applications it may be desirable to employ a generally rigid container and pressurize the container interior at selected times with a piston or other pressurizing system. As shown in FIG. 2, the container 10 will typically contain a liquid (L) and air occupying a head space (H). A dip tube 64 extends from the closure 5 through the head space (H) and into the liquid (L).

Referring particularly to FIGS. 2 and 6–8, the closure 5 includes a spray plug 30 which comprises a spray plug deck 31, which, in this example, is generally planar but which may be of other shapes, for example, dome-shaped. A spray plug skirt 32 extends from the periphery of the spray plug deck 31 and is adapted to engage and cooperate with the container neck 12 to retain the spray plug 30 on the container 10. In this exemplary embodiment, the spray plug skirt 32 is retained on the container 10 using a snap-fit means and includes a spray plug skirt retaining lip 34 which extends inward from an internal surface of the spray plug skirt 32 and is adapted to engage a corresponding neck lip 14 on the container neck 12 to retain the spray plug 30 thereon. The spray plug skirt retaining lip 34 preferably includes a tapered surface which slides over a like tapered surface on the neck lip 14 thereby temporarily and elastically deforming outward the spray plug skirt 32 as the spray plug 30 is installed on the container 10. As the spray plug 30 is further pushed onto the container 10 and the spray plug skirt retaining lip 34 is pushed past the neck lip 14, the spray plug skirt 32 will reform and corresponding abutting surfaces on the spray plug skirt retaining lip 34 and the neck lip 14 will prevent upward movement of the spray plug 30 relative to the container 10.

As an alternative to the snap-fit means described relative to this exemplary embodiment, the spray plug skirt 32 and container neck 12 could cooperate through a different fastening means. For example, a threaded fitting (not illustrated). The spray plug skirt 32 could also be permanently attached to the container by means of induction melting, ultrasonic melting, gluing, or the like, depending on materials used for the spray plug 30 and in the container 10. The spray plug 30 could also be formed as a unitary part, or extension, of the container 10.

As best seen in FIGS. 2 and 6–8, the spray plug 30 preferably includes an annular plug seal 36 which extends downward from the spray plug deck 31 and which is adapted to sealingly engage an interior surface 16 of the container neck 12 to prevent unwanted escape of liquid or air through the spray plug/container interface. The spray plug 30 also includes a spray plug outer wall 38 and a spray plug inner wall 42 which extend upward from the spray plug deck 31 in a direction generally opposite the spray plug skirt 32 and spray plug seal 36. The spray plug inner wall 42 is supported on a plurality of spray plug inner wall support arms 44 (FIG. 6) which are formed in the spray plug deck 31 and extend radially inwardly from the spray plug outer wall 38. The spray plug inner wall support arms 44 also form a plurality of spray plug outer passages 46 between them to permit the flow of air from the container head space (H) through the spray plug deck 31 and into an annular spray plug air flow space 47 (FIGS. 3 and 8) defined between the spray plug outer wall 38 and spray plug inner wall 42.

The spray plug outer wall 38 and spray plug inner wall 42 cooperate with corresponding walls on the cap 100 to form air and product chambers in a manner that will be explained below. The spray plug outer wall 38 includes a radially inwardly projecting spray plug outer wall seal bead 41 (FIG. 8) extending from the spray plug outer wall interior surface 40. Similarly, the spray plug inner wall 42 includes a radially inwardly projecting spray plug inner wall seal bead 43. Both of these seal beads, 41 and 43, slidingly engage and form dynamic seals with respective walls on the cap 100 as will be explained below.

Figure 4:
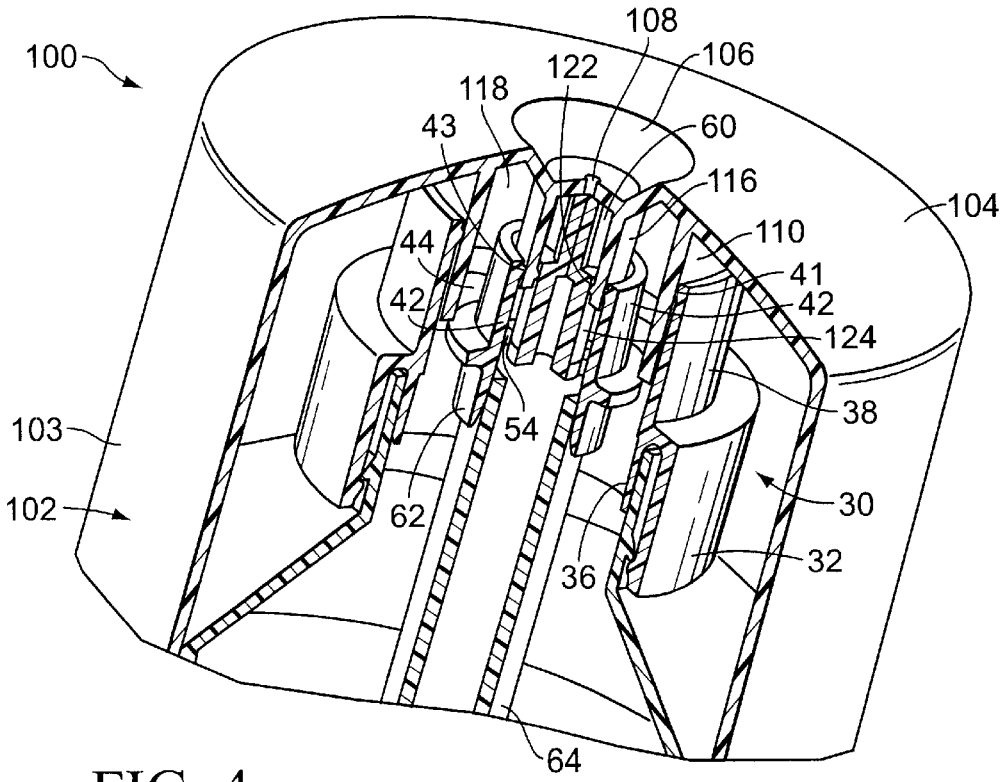
FIG. 4 is a perspective, fragmentary view of the exemplary closure of FIG. 1 shown in a closed position.
Figure 5:
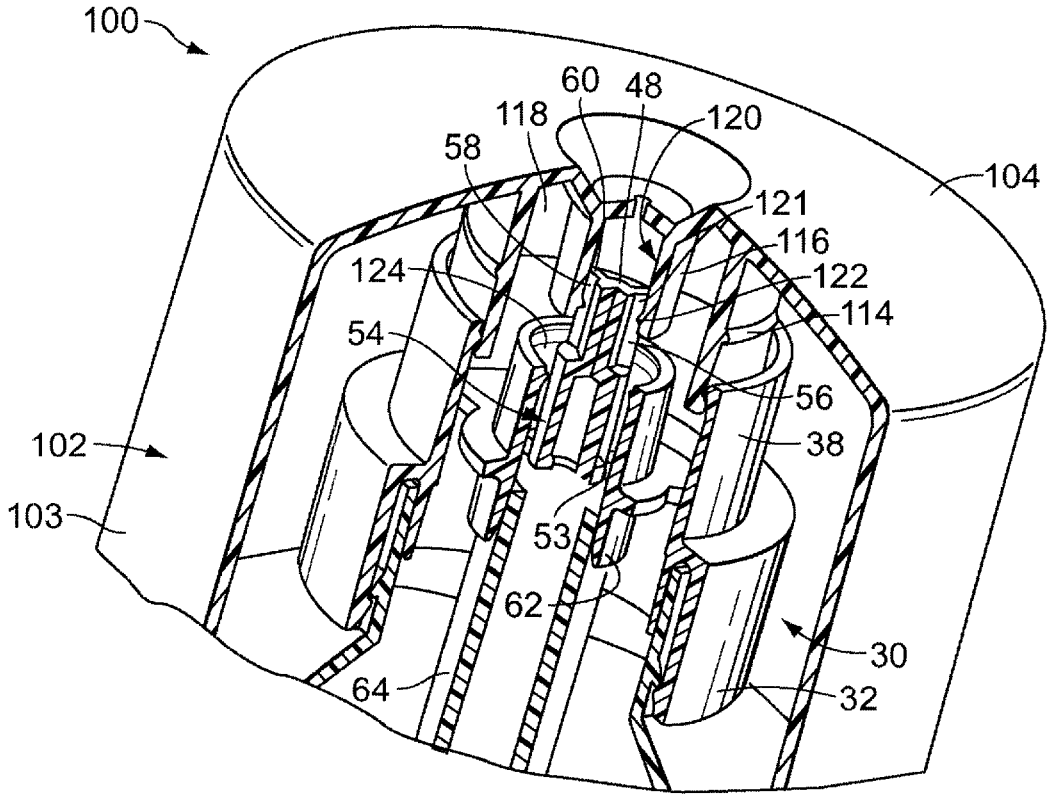
FIG. 5 is a perspective, fragmentary view of the exemplary closure of FIG. 1 shown in an open position.
Figure 6:
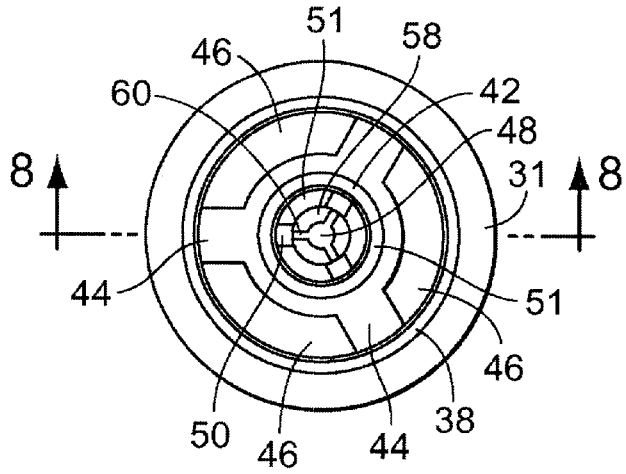
FIG. 6 is a top view of the exemplary spray plug of the closure of FIG. 1.
Figure 7:
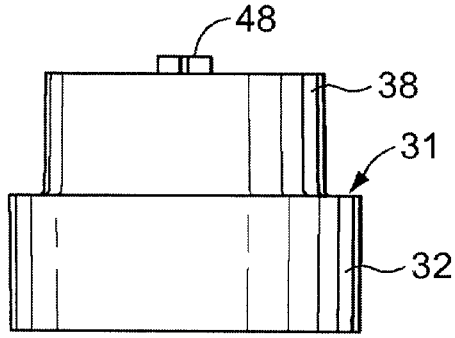
FIG. 7 is a side elevational view of the exemplary spray plug of the closure of FIG. 1.
Figure 8:
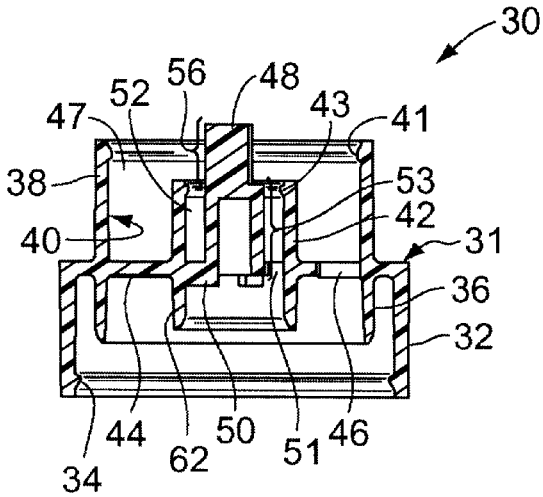
FIG. 8 is a cross-sectional view taken along lines 8—8 of FIG. 6.

A central spray plug post 48 extends upward from the spray plug deck 31 and is supported on a plurality of spray plug post support arms 50 extending radially inwardly from the spray plug inner wall 42 as shown in FIGS. 6 and 8. A dip tube engaging wall 62 (FIG. 8) extends downward from the spray plug deck 31 for frictionally engaging and retaining a dip tube 64 (FIGS. 2, 3, 4 and 5). The spray plug post support arms 50 also form a plurality of spray plug product passages 51 between them to permit the flow of product from the dip tube 64 through the spray plug deck 31 and into a spray plug product flow space 52 defined between the spray plug inner wall 42 and spray plug post 48 (FIGS. 1 and 8).

As best seen in FIG. 5, the spray plug post 48 includes a lower portion 53, having a smooth external sealing surface 54, and an upper portion 56 having a plurality of radial arms 60 extending outward and forming axial grooves 58 defined between them. These axial grooves 58 form restrictive passages 121 with an inner wall 116 of the cap 100 to restrict the flow of spray mist out of the closure 5 in a manner that will be explained below.

Figure 3:
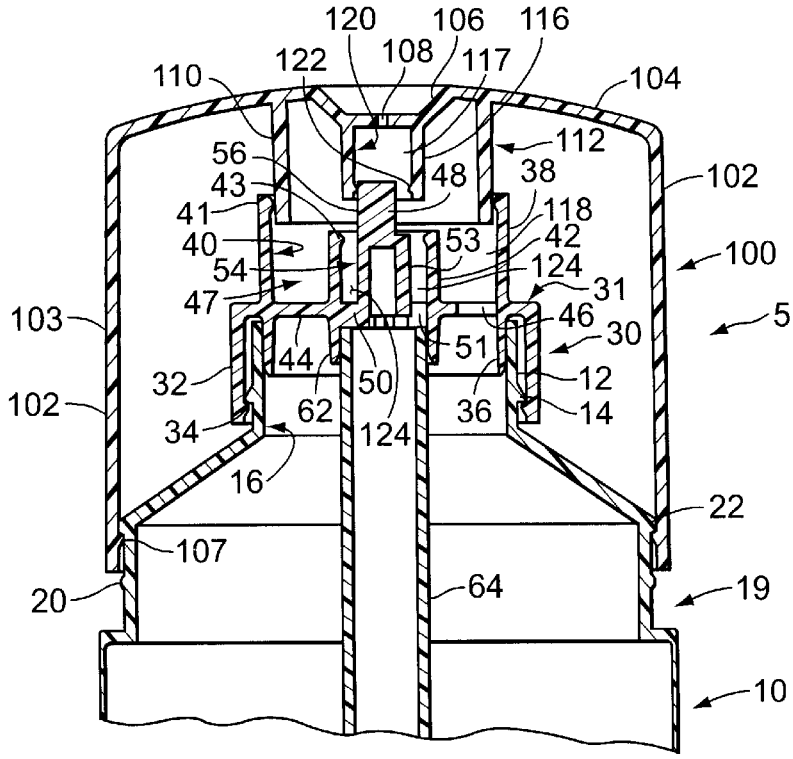
FIG. 3 is a cross-sectional view taken along lines 2—2 of FIG. 1, showing the exemplary dispensing closure in an open position.

The exemplary closure 5 also includes a cap 100 which is adapted to move between an open position (FIGS. 3 and 5) and a closed position (FIGS. 2 and 4) and which cooperates with the spray plug 30 to define an outer chamber 118 and an inner chamber 124 (FIG. 3). The cap 100 includes a cap outer shell 102 (FIGS. 4 and 5) which includes a cap skirt 103 that extends downward from the periphery of a cap end wall 104. The cap end wall 104 includes a cap recess 106 formed therein and a cap dispensing orifice 108 for permitting flow of spray mist through the cap end wall 104 in a controlled manner. The cap skirt 103 includes an inwardly projecting cap skirt locking bead 107 (FIGS. 2 and 3) which cooperates with structure on the container 10 to retain the cap 100 in the closed position (FIGS. 3 and 5). Specifically, in this exemplary embodiment, the container 10 is provided with a recessed upper portion 19 (FIGS. 2 and 3) which receives a lower end of the cap skirt 103 and which is provided with an outwardly projecting cap retention bead 20 and an outwardly projecting cap travel-limiting shoulder 22. The cap retention bead 20 is preferably dimensioned to provide a first degree of interference with the cap skirt locking bead 107, which interference may be overcome by the user to move the cap 100 from the closed position to the open position and back to the closed position. The cap travel-limiting shoulder 22 is preferably dimensioned to provide a second degree of interference, greater than the first degree of interference, in order to prevent upward travel of the cap 100 beyond a predetermined distance. Although not apparent from the figures, the cap travel-limiting shoulder 22 is preferably provided with an upper tapered surface, to permit downward travel of the cap skirt 103 past the cap travel-limiting shoulder 22 during assembly, and a lower abutment surface, to provide positive engagement with the cap skirt locking bead 107 when the cap 100 is moved to its upper limit of travel.

The exemplary cap 100 includes an annular cap outer wall 110 (FIG. 3) which extends downward from the cap end wall 104 and which includes a cap outer wall outer surface 112 which is adapted to slidingly and sealingly engage the spray plug outer wall 38 via the spray plug outer wall seal bead 41. The cap 100 also includes an annular cap inner wall 116 which defines a mixing chamber 117 (FIG. 3) and is dimensioned to occupy the inner annular space 52 between the spray plug post 48 when the cap 100 is in the closed position (FIGS. 2 and 4). When the cap 100 is in the closed position, the cap inner wall 116 sealingly engages the spray plug post lower portion external surface 54 (FIG. 4) via a cap inner wall seal bead 122, and the seal bead 43 on the spray plug inner wall 42 sealingly engages the exterior surface of the cap inner wall 116.

As is apparent from FIGS. 2 and 4, the cap 100 cooperates with the spray plug 30 to define an outer chamber 118 and an inner chamber 124 when the cap 100 is in the closed position. The chambers 118 and 124 can be characterized as also existing, albeit in communication with each other, when the cap 100 is in the open position too. Specifically, the cap outer wall 110 and spray plug outer wall 38 form a first annular barrier which is extensible and thus maintained as the cap 100 moves from its closed position to an open position. The cap inner wall 116 and the spray plug inner wall 42 form a second annular barrier when the cap is in the closed position. Thus, the outer chamber 118 is formed by the cap outer wall 110, the spray plug outer wall 38, a portion of the cap end wall 104, the cap inner wall 116 and the spray plug inner wall 42. This outer chamber 118 is in communication with air in the container headspace (H) via the air passages 46 formed in the spray plug deck 31. Similarly, when the cap 100 is in the closed position, an inner chamber 124 (FIG. 4) is formed by the spray plug post lower portion external surface 54, the spray plug inner wall 42 and the cap inner wall 116. The inner chamber 124 is in communication with product in the dip tube 64 via the product passages 51

(FIGS. 2 and 8) formed in the spray plug deck 31. As is apparent, when the cap 100 is in the closed position, the inner chamber 124 is isolated from the outer chamber 118.

In operation of the exemplary embodiment, a user moves the cap 100 from the closed position (FIGS. 2 and 4) to the open position (FIGS. 3 and 5) by applying an axial force, for example, by gripping the outside of the cap skirt 102, and pulling upward on the cap 100. After a sufficient upward force is applied to the cap 100 to overcome the interference between the cap locking bead 107 and the cap retention bead 20 on the container 10, the cap 100 will travel upward to its open position defined by the cap travel-limiting shoulder 22. In the open position (FIGS. 3 and 5), the cap inner wall 116 is removed from the annular space between the spray plug post 48 and the spray plug inner wall 42. Moreover, the sealing contact between the cap inner wall 116 and the spray plug inner wall 42 is broken. Thus, the outer chamber 118 and inner chamber 124 are in communication to permit the mixing of air and product when the container is squeezed to force air and product into the closure 5. The cap inner wall is also brought out of sealing engagement with the lower portion 53 of the spray plug post 48 and surrounds the spray plug post arms 60 and interspersed grooves 58 to form a plurality of restrictive passages 121 to enhance the misting properties of the closure 5. An air/product mixture enters the restrictive passages 121 and travels upward and out of the cap dispensing orifice 108 as a mist spray.

Those of ordinary skill in the art will recognize that modifications to the cap structure may be made without departing from the spirit and scope of the invention. For example, the cap outer wall 110 may be eliminated and the spray plug outer wall 38 configured to form a dynamic seal with the cap inner wall 116.

Figure 9:
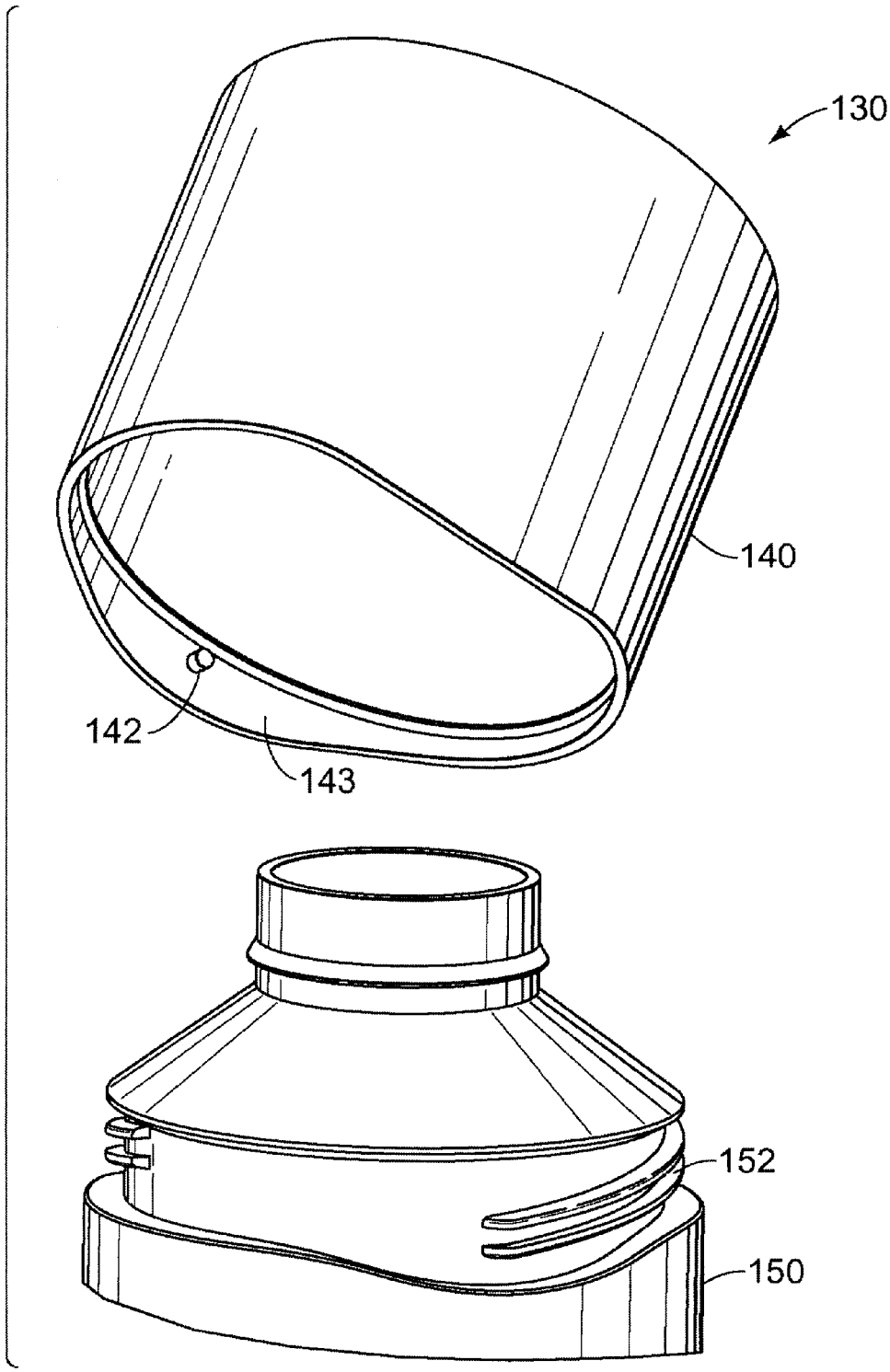
FIG. 9 is an exploded, fragmentary view of an exemplary closure and container according to another preferred embodiment of the invention.
Figure 10:
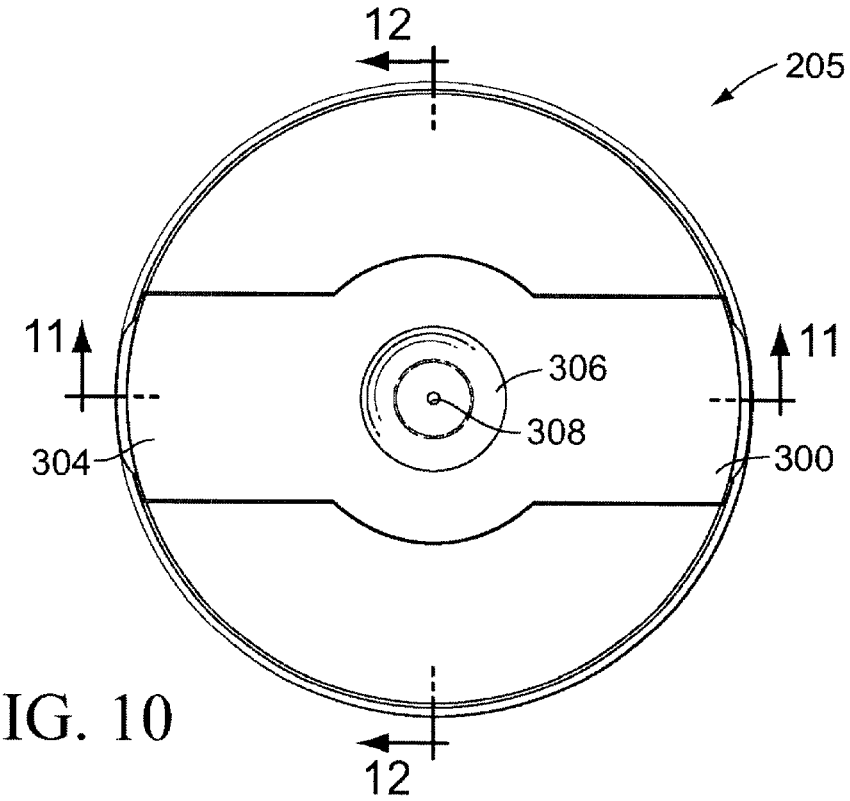
FIG. 10 is a top plan view of an exemplary dispensing closure according to yet another preferred embodiment of the invention.

Those of ordinary skill in the art will also recognize that the axial movement of the cap 100 relative to the spray plug 30 may be effected in various ways. For example, in place of the exemplary cap 100 which may be moved by a user to the open position, the invention may provide a cap which is rotated with respect to a container 10 and which is provided with a camming means. FIG. 9 illustrates an exemplary closure 130 according to another preferred embodiment of the invention in which the axially movable cap 100 of the embodiment illustrated in FIGS. 1–8 is replaced with a rotationally actuated cap 140. In this embodiment, at least one track engaging post 142 is provided near a lower edge of the cap skirt 143 and is adapted to engage at least one track 152 formed on the neck finish of a container 150. Although not illustrated in FIG. 9, the spray plug details may be the same as described in the embodiment of FIGS. 1–8 and the walls (not shown) of the cap permit rotational movement of the cap relative to the spray plug or even rotation of the spray plug relative to the container. As will be understood, once the cap is installed on the container 150, with the track engaging posts 142 located within the tracks 152, counterclockwise rotation of the cap 140 will result in an upward movement of the cap 140 relative to the container 150 to open the flow paths in the closure.

As a further alternative, a camming means or track may be provided on the spray plug instead of the container, for example, using a track formed on the interior or exterior surface of the spray plug outer wall. In that instance, one or more track-engaging posts may be formed on the cap outer wall for engaging the track.

Referring now to FIGS. 10–19, there is illustrated an exemplary closure according to yet another preferred embodiment of the invention. This embodiment is advantageous for use on containers with neck finishes which have a limited internal dimension, i.e., internal diameter, which might not permit the use of both inner and outer passages of the above-described embodiments illustrated in FIGS. 1–9. The embodiment illustrated in FIGS. 10–19 utilizes only a single set of inner passages, and the mixing of air and product is accomplished upstream of the single set of passages as will be described. In addition, the spray plug is formed with an outer shell having an outer skirt and which cooperates with a non-cylindrical cap member as will be described.

Figure 15:
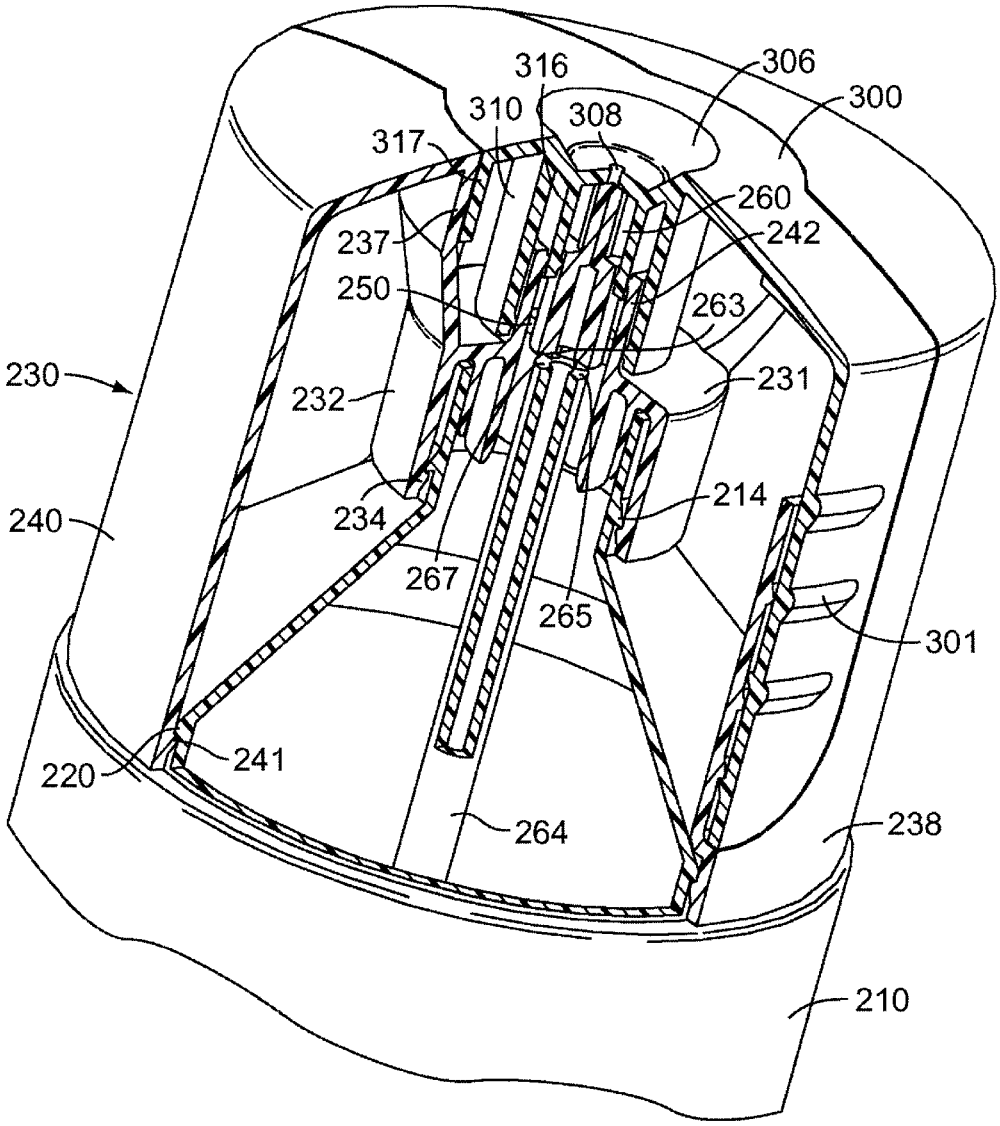
FIG. 15 is an enlarged, perspective, fragmentary view of the exemplary closure of FIG. 10 shown in a closed position.
Figure 16:
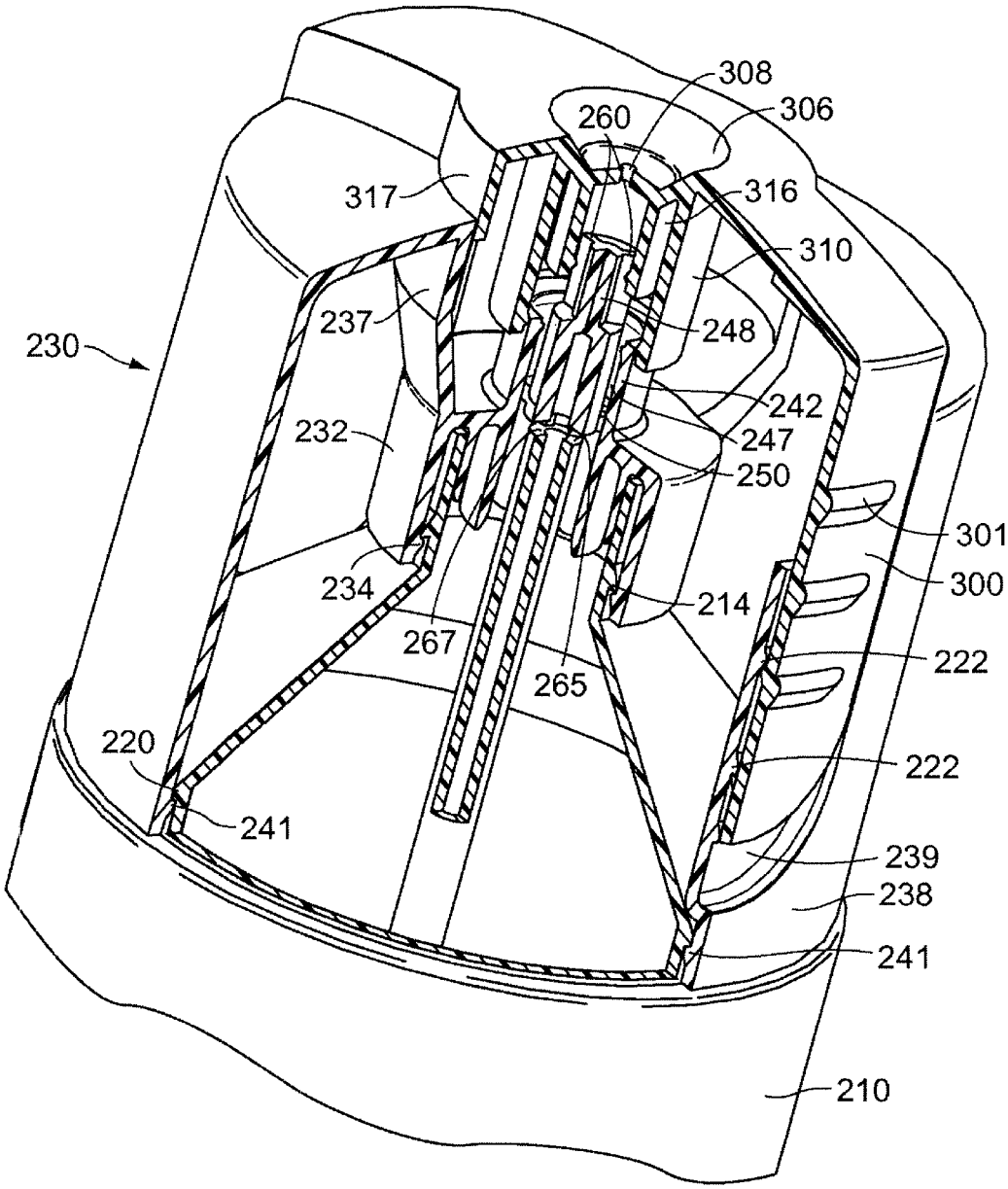
FIG. 16 is an enlarged, perspective, fragmentary view of the exemplary closure of FIG. 10 shown in an open position.
Figure 17:
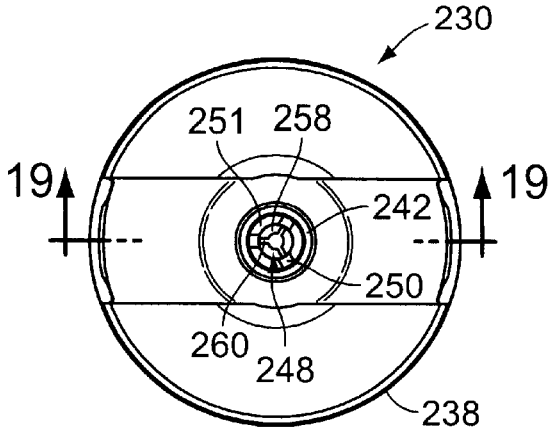
FIG. 17 is a top view of the spray plug from the closure of FIG. 10.
Figure 18:
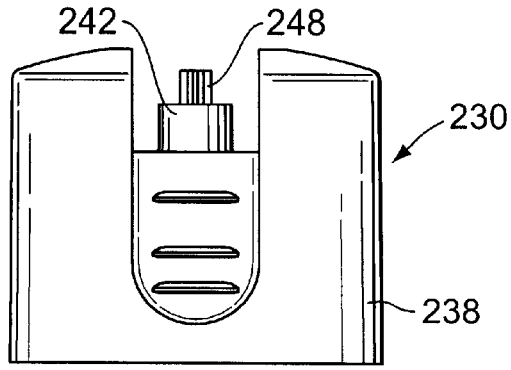
FIG. 18 is a front view of the spray plug from the closure of FIG. 17.
Figure 19:
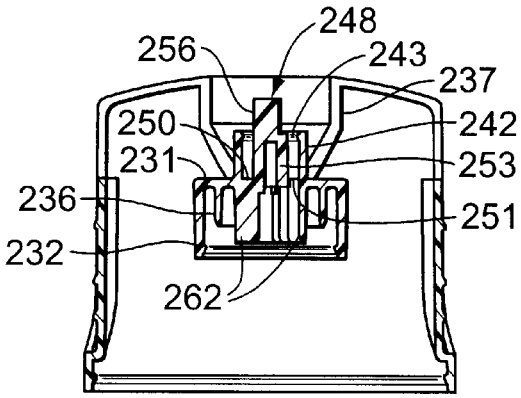
FIG. 19 is a cross-sectional view taken along lines 19—19 of FIG. 17.

An exemplary closure according to this preferred embodiment of the invention is generally referenced with the number 205 and illustrated in FIGS. 10–16 in association with a squeezable container 210 (partially illustrated in FIGS. 11–16). The exemplary closure 205 includes a spray plug 230 which comprises a spray plug deck 231. As best seen in FIGS. 17–19, a spray plug skirt 232 extends from the periphery of the spray plug deck 231 and is adapted to engage and cooperate with the container neck 212 to retain the spray plug 230 on the container 210 (not illustrated in FIGS. 17–19). In this exemplary embodiment, referring additionally to FIGS. 15 and 16, the spray plug skirt 232 is retained on the container 210 using a snap-fit means and includes a spray plug skirt retaining lip 234 which extends inward from an internal surface of the spray plug skirt 232 and is adapted to engage a corresponding neck lip 214 on the container neck 212 to retain the spray plug 230 thereon. The spray plug skirt retaining lip 234 preferably includes a tapered surface which slides over a like tapered surface on the neck lip 214 thereby temporarily and elastically deforming outward the spray plug skirt 232 as the spray plug 230 is installed on the container 210. As the spray plug 230 is further pushed onto the container 210 and the spray plug skirt retaining lip 234 is pushed past the neck lip 214, the spray plug skirt 232 will reform and corresponding abutting surfaces on the spray plug skirt retaining lip 234 and the neck lip 214 will prevent upward movement of the spray plug 230 relative to the container 210.

As an alternative to the snap-fit means described relative to this exemplary embodiment, the spray plug skirt 232 and container neck 212 could cooperate through a different fastening means, for example, a threaded fitting (not illustrated). The spray plug skirt 232 could also be permanently attached to the container by means of induction melting, ultrasonic melting, gluing, or the like, depending on materials used for the spray plug 230 and in the container 210.

The spray plug 230 preferably includes a spray plug seal 236 which extends downward from the spray plug deck 231 and which is adapted to sealingly engage an interior surface 216 of the container neck 212 to prevent unwanted escape of liquid or air through the spray plug/container interface. The spray plug 230 includes a spray plug inner wall 242 (best seen in FIGS. 11–16, 18 and 19) which extends upward from the spray plug deck 231 in a direction generally opposite the spray plug skirt 232 and spray plug seal 236. The spray plug inner wall 242 surrounds a spray plug post 248 to form an annular inner flow space 247 therewith. As best seen in FIGS. 16 and 17, a plurality of spray plug post support arms 250 extend radially inward from the spray plug inner wall 242 and support the spray plug post 248, forming a like plurality of inner passages 251 to permit flow from below the spray plug deck 231.

Figure 11:
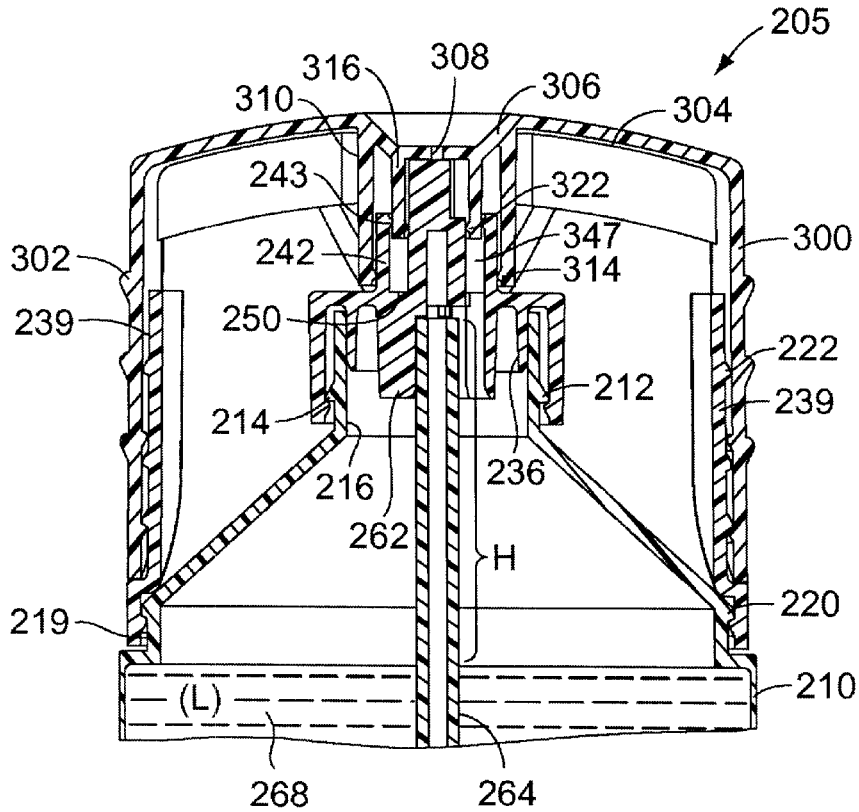
FIG. 11 is a fragmentary, cross-sectional view taken along lines 11—11 of FIG. 10 with the closure in a closed position and shown installed on a container.
Figure 12:
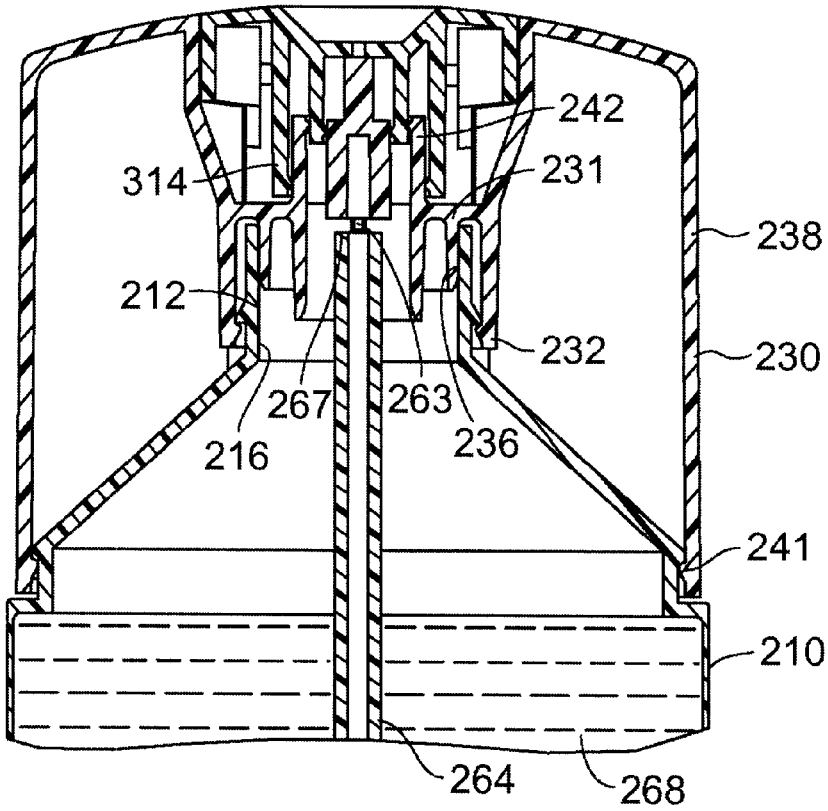
FIG. 12 is a fragmentary, cross-sectional view taken along lines 12—12 of FIG. 10 with the closure in a closed position.
Figure 13:
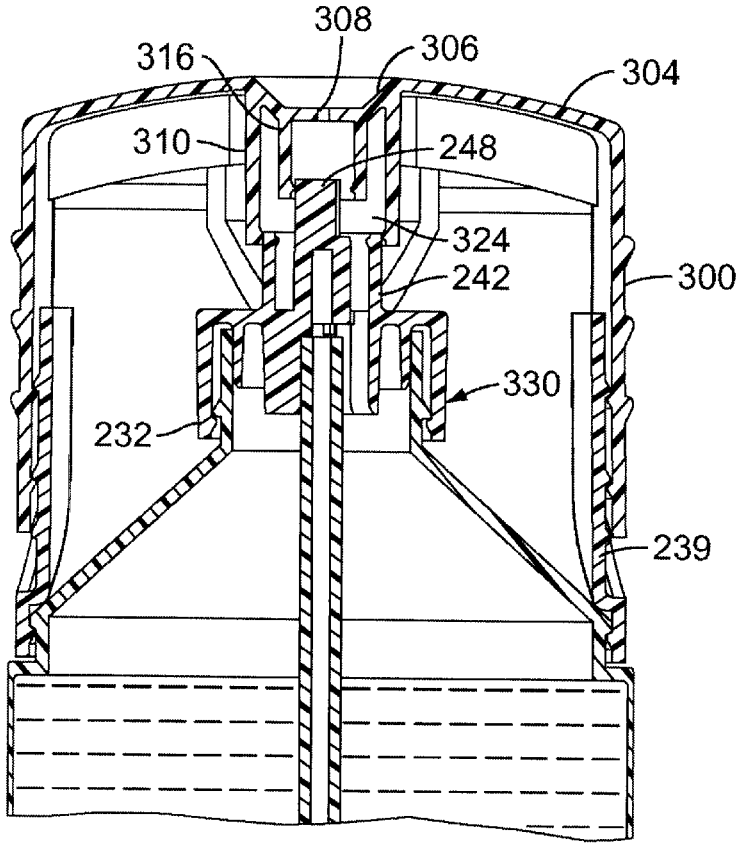
FIG. 13 is a fragmentary, cross-sectional view taken along lines 11—11 of FIG. 10 with the closure in an open position.
Figure 14:
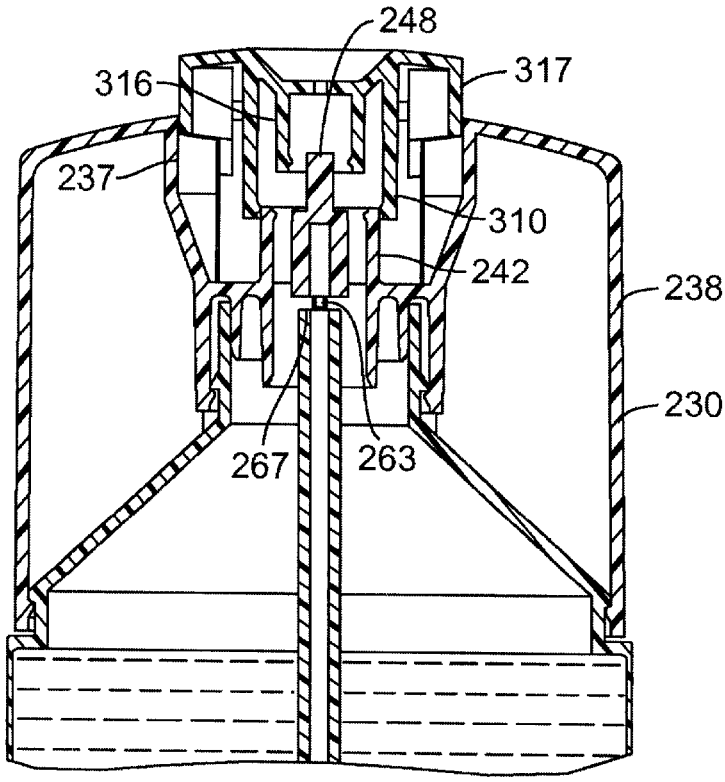
FIG. 14 is a fragmentary, cross-sectional view taken along lines 12—12 of FIG. 10 with the closure in an open position.

As best seen in FIGS. 11 and 19, the spray plug 230 also includes at least one dip tube engaging member 262 extending from each spray plug post support arm 250 for frictionally engaging an external surface of a dip tube 264 and retaining the dip tube 264 in a fixed position relative to the spray plug 230. As best seen in FIG. 12, a proximal end 267 of the dip tube 264 is engaged by one or more dip tube end engaging ribs 263 which form with an end surface of the dip tube 264 one or more dip tube exit passages 265 (FIGS. 15 and 16) for permitting the flow of product from within the dip tube 264, out of the proximal end 267 and into the inner passages 251 to enable mixing of the product with air contained in the container head space. The dip tube 264 extends from the spray plug 230 through the container head space (H, FIG. 11), and the dip tube has a distal end (not shown, but similar to that illustrated in FIG. 2) with a dip tube inlet communicating with liquid product (L) in the container. Thus, a mixture of air and product is permitted to flow through the inner passages 251 when the closure 205 is in an open position as will be described.

As can be seen in FIG. 12 and 16–19, the spray plug 230 also includes an outer shell 238 which has two generally semi-circular shaped top end wall portions (FIG. 10) and a generally cylindrical side wall or outer skirt 240 with recessed portions 239 (FIG. 16) that receive a cap 300 as will be described. The spray plug outer skirt 240 has a spray plug outer skirt locking bead 241 for engaging a corresponding spray plug retention bead or shoulder 220 formed on the container 210 (FIG. 16). Formed on the recessed portions 239 is at least one travel limiting shoulder or bead 222 which is adapted to limit the upward movement of or define predetermined stop positions of the cap 300.

The exemplary cap 300 is of a generally U-shaped configuration and is shaped to fit within the spray plug outer shell 238 in complementary fashion with the recesses 239 of the spray plug shell 238 (FIG. 16) such that the cap 300 and spray plug outer shell 238 form a generally cylindrical shape when the cap 300 is in the closed position, best seen in FIG. 15. The cap 300 a pair of arcuate cap guiding walls 317 for engaging respective spray plug cap guiding walls 237 (FIG. 16). The cap 300 includes a cap outer wall 310 which is adapted to sealingly engage an outer surface of the spray plug inner wall 242. For this purpose, a cap outer wall seal bead 314 is formed on an interior surface of the cap outer wall 310. The seal bead 314 also functions to permit ease of assembly of the closure 205 by providing for the spray plug 230 to be retained within the cap 300 before the spray plug 230 and cap 300 are assembled on to the container 210 as a unit. A plurality of gripping ribs 301 (FIGS. 15 and 16) are formed on an exterior surface of the cap 300 for improving the user's grip thereof.

The cap 300 includes an inner wall 316 which is provided with a cap inner wall seal bead 322 and which is adapted to sealingly engage an exterior surface of the spray plug post 248. The spray plug post 248 includes (1) a lower portion 253 (FIG. 19) having a generally smooth cylindrical exterior surface, and (2) an upper portion 256 (FIG. 19) which includes a plurality of radially extending spray plug post arms 260 (FIGS. 16 and 17) forming spray plug post grooves 258 (FIG. 17) between them. The cap inner wall 316 and spray plug upper portion 256 (FIG. 19) form a plurality of restrictive passages when the cap 300 is moved to the open position shown in FIGS. 13, 14 and 16 to permit flow of the product/air mixture through the cap dispensing orifice 308.

As is apparent from FIGS. 11–16, the cap 300 cooperates with the spray plug 230 to occlude the annular inner flow space 247 when the cap is in the closed position shown in FIGS. 11, 12 and 15. Specifically, when the cap 300 is in the closed position, the cap inner wall 316 occupies the annular inner flow space 247 and forms a seal with the smooth exterior surface of the spray plug post lower portion 253 and thereby prevents flow of air and product through the inner passages 251. Also, when the cap 300 is in the closed position, the exterior surface of the cap inner wall 316 is sealingly engaged by a seal bead 243 (FIGS. 11 and 19) on the upper end of the spray plug inner wall 242. When the cap 300 is moved to the open position, the cap inner wall 316 is removed from the annular inner flow space 247 and the cap inner wall 316 forms a plurality of restrictive passages with the upper portion 256 of the spray plug post 248 to permit flow of air and product mixture from the container 210 and through the dispensing orifice 308.

Some of the features of the "push-pull" embodiments (FIGS. 1–8 and 10–19) need not be annular or circular features. For example, the spray plug post and the walls of the plug above the deck could be polygonal, and the cooperating interior walls of cap could be polygonal.

In the above-described embodiments, the spray plug post defines axially oriented, flow discharge grooves, such as grooves 58 (FIGS. 5 and 6) and grooves 258 (FIG. 17). These grooves extend longitudinally parallel to the central longitudinal axis of the closure. However, it will be appreciated that in a modified design (not illustrated), such grooves could have other orientations or configurations, such as helical.

It will be readily apparent from the foregoing detailed description of the invention and from the illustrations thereof that numerous variations and modifications may be effected without departing from the true spirit and scope of the novel concepts or principles of this invention.

What is claimed is:

1. A spray closure for a container for producing a mist spray, the spray closure comprising:

(A) a spray plug for engaging the container, the spray plug including
  (1) a spray plug seal for sealingly engaging the container;
  (2) a spray plug post;
  (3) a spray plug inner wall spaced from, and surrounding, the spray plug post to define a product flow space therewith for communicating with product in the container;
  (4) a spray plug outer wall spaced from, and surrounding, the spray plug inner wall to define an air flow space therewith; and (B) a cap cooperating with the spray plug and adapted to move with respect to the spray plug from a closed position to an open position; the cap including:
  (1) a cap inner wall that (a) defines a mixing chamber on an interior thereof and (b) is adapted to isolate the product flow space from the air flow space when the cap is in the closed position, the cap inner wall further adapted to permit fluid communication between the product flow space and the air flow space when the cap is moved to the open position, thereby permitting the mixing of air and product to form a mist in the mixing chamber; and
  (2) a cap orifice in fluid communication with the mixing chamber for permitting flow of mist from the mixing chamber.

2. The spray closure according to claim 1 wherein the spray plug post includes a lower portion, adapted to sealingly engage the cap inner wall, and an upper portion, adapted to form at least one restrictive passage with the cap inner wall when the cap is in the open position.

3. A spray closure for a container for producing a mist spray, the spray closure comprising:

(A) a spray plug for engaging the container, the spray plug including
(1) a spray plug deck;
(2) a spray plug seal extending from the deck for sealingly engaging the container;
(3) a spray plug post extending from the deck in a direction generally opposite the spray plug seal;
(4) a spray plug inner wall extending from the deck and surrounding the spray plug post to define a product flow space therewith;
(5) at least one product passage formed in the spray plug deck between the spray plug post and the spray plug inner wall for permitting flow of product from the container through the spray plug deck to the product flow space;
(6) a spray plug outer wall extending from the spray plug deck surrounding the spray plug inner wall to define an air flow space therewith; and
(7) at least one air passage formed in the spray plug deck between the spray plug outer wall and the spray plug inner wall for permitting flow of air from the container through the spray plug deck to the air flow space; and (B) a cap cooperating with the spray plug and adapted to move with respect to the spray plug from a closed position to an open position; the cap including:
(1) a cap inner wall defining a mixing chamber on an interior thereof and adapted to isolate the product flow space from the air flow space when the cap is in the closed position, the cap inner wall further adapted to permit fluid communication between the product flow space and the air flow space when the cap is moved to the open position, thereby permitting the mixing of air and product to form a mist in the mixing chamber;
(2) a cap outer wall adapted to sealingly engage the spray plug outer wall at the open and closed position and at any intermediate position; and
(3) a cap orifice in fluid communication with the mixing chamber for permitting flow of mist from the mixing chamber.

4. A spray closure for a container for producing a mist spray, the spray closure comprising:

(A) a spray plug for engaging the container, the spray plug including
at least one air passage formed therein for permitting flow of air from the container through the spray plug;
at least one product passage formed therein for permitting flow of product from the container through the spray plug; and (B) a cap cooperating with the spray plug and adapted to move with respect to the spray plug from a closed position to an open position, the cap including a dispensing orifice for permitting flow of mist spray through the cap;

(C) the cap and spray plug cooperating to define:
(1) an air chamber in communication with the at least one air passage;
(2) a product chamber in communication with the at least one product passage; and
(3) an isolation seal for isolating the air chamber from the product chamber when the cap is in the closed position, the isolation seal permitting communication between the air chamber, the product chamber and the dispensing orifice when the cap is in the open position.

5. A spray closure for a container, including a container opening, for producing a spray, the spray closure comprising:

(A) a spray plug for engaging the container adjacent the opening, the plug including
(1) a spray plug skirt for supporting the spray plug on the container;
(2) a spray plug post supported relative to the spray plug skirt, said spray plug post having an upper end surface;
(3) an plug wall substantially surrounding the spray plug post to define a flow space therewith;
(4) at least one passage in the spray plug for permitting flow from the container into the flow space; and (B) a cap cooperating with the spray plug and adapted to move with respect to the spray plug from a closed position to an open position, the cap including:
(1) an end wall defining a dispensing orifice defined therein for permitting flow through the cap; and
(2) an inner wall extending from the end wall and adapted to seal the flow space when the cap is in the closed position to thereby prevent flow from the flow space, cap end wall engaging said spray plug upper end surface when said cap is in the closed position to block said dispensing orifice and eliminate any accumulation volume between said dispensing orifice and said spray plug post upper end surface.

6. The spray closure of claim 5 wherein the inner wall and spray plug post define at least one restrictive passage for permitting flow from the flow space to the dispensing orifice when the cap is in the open position.

7. The spray closure of claim 5 wherein the plug wall is generally annular.

8. The spray closure of claim 5 wherein the flow space is a generally annular flow space.

9. The spray closure of claim 5 wherein the plug wall is an inner plug wall; and the spray plug includes an outer wall, spaced from and surrounding the inner plug wall.

10. The spray closure of claim 9 wherein the cap includes an outer wall sealingly engaged with the spray plug inner wall to define an air flow space; and the spray plug has at least one passage for permitting flow of air from the container into the air flow space.

11. The spray closure of claim 5 wherein the spray plug wall has an exterior surface; and the cap includes an outer wall sealingly engaged with the exterior surface of the spray plug wall to contain flow discharging from the flow space within a region adjacent to the dispensing orifice when the closure is in the open position.

12. The spray closure of claim 5 wherein the spray plug post includes 1) an upper portion having a plurality of radially extending arms defining at least one restrictive passage with the cap inner wall when the cap is in the open position and 2) a lower portion having a smooth outer surface adapted to sealingly engage the cap inner wall when the cap is in the closed position.

13. The spray closure of claim 5 wherein the spray plug further comprises an outer shell.

14. The spray closure of claim 13 wherein the outer shell has two generally semi-circular shaped top end wall portions and wherein the cap is generally U-shaped and is disposed between the two semi-circular top end wall portions.

15. The spray closure of claim 5 wherein the at least one passage is defined in the spray plug only in a region between the spray plug wall and the spray plug post.

16. The spray closure of claim 15 wherein the spray plug further comprises a) a dip tube engaging wall for engaging a dip tube and b) a plurality of dip tube engaging ribs adapted to form at least one dip tube exit passage with a proximal end of the dip tube to permit flow of product from the dip tube through the at least one passage.

17. The spray closure of claim 5 wherein the flow space is a product flow space for permitting flow of product from the container and wherein the spray plug further comprises a spray plug outer wall spaced from and surrounding the spray plug wall to define an air flow space therewith for permitting flow of air from the container.

18. The spray closure of claim 17 wherein the cap further comprises a cap outer wall adapted to slidingly and sealingly engage the spray plug outer wall.

19. The spray closure of claim 5 wherein the cap is adapted to move from the open position to the closed position through rotational movement relative to the container.

20. The spray closure of claim 19 wherein the cap includes at least one post for engaging a track on the container.

21. A spray closure for a container, including a container opening, for producing a spray, the spray closure comprising:

(A) a spray plug for engaging the container adjacent the opening, the plug including (1) a spray plug skirt for supporting the spray plug on the container;

(2) a spray plug post supported relative to the spray plug skirt;

(3) an plug wall substantially surrounding the spray plug post to define a flow space therewith;

(4) least one passage in the spray plug for permitting flow from the container into the flow space; and (5) two generally semi-circular shaped top end wall portions spaced apart on either side of said spray plug post; and (B) a cap cooperating with the spray plug and adapted to move with respect to the spray plug from a closed position to an open position, and said cap having a generally inverted U-shaped configuration including:

(1) an end wall disposed generally between said spray plug two spaced-apart top end wall portions, and defining a dispensing orifice defined therein for permitting flow through the cap; and (2) an inner wall extending from the end wall and adapted to seal the flow space when the cap is in the closed position to thereby prevent flow from the flow space out of the spray plug.

* * * * *